United States Patent [19]

Wang

[11] Patent Number: 4,977,034

[45] Date of Patent: Dec. 11, 1990

[54] PROCESS FOR COEXTRUSION BILLETS WITH MULTIPLE METALLIC CYLINDRICAL LAYERS BY HOT ISOSTATIC PRESSING AND PRODUCT

[75] Inventor: Chun T. Wang, Salem, Oreg.

[73] Assignee: Teledyne Industries, Inc., Albany, Oreg.

[21] Appl. No.: 432,897

[22] Filed: Nov. 7, 1989

[51] Int. Cl.[5] ..... G22F 7/00

[52] U.S. Cl. ..... 428/548; 419/8; 419/41; 419/49; 419/57; 428/636; 428/660

[58] Field of Search ..... 419/8, 41, 49, 57; 428/548, 636, 660

[56] References Cited

U.S. PATENT DOCUMENTS

| | | | |
|---|---|---|---|
| 4,049,184 | 9/1977 | Rozengart et al. | 228/131 |
| 4,065,302 | 12/1977 | Turillon | 75/226 |
| 4,372,817 | 2/1983 | Armijo et al. | 376/417 |
| 4,478,363 | 10/1984 | Imahashi et al. | 228/131 |
| 4,754,911 | 7/1988 | Turner | 228/131 |
| 4,808,485 | 2/1989 | Prewo et al. | 428/582 |

*Primary Examiner*—Stephen J. Lechert, Jr.

*Attorney, Agent, or Firm*—Shoemaker and Mattare, Ltd.

[57] ABSTRACT

Coextrusion billets of two or more concentric metallic layers treated by a hot isostatic pressing (HIP) process in order to form a defect-free bondline between the contiguous touching metal layers. The HIP process can also be applied to extruded or further reduced tubes in order to heal bondline defects.

6 Claims, 3 Drawing Sheets

PROCESS FOR COEXTRUSION BILLETS WITH MULTIPLE METALLIC CYLINDRICAL LAYERS BY HOT ISOSTATIC PRESSING AND PRODUCT

FIELD OF THE INVENTION

This invention relates to an improved method of fabricating multi-layered tubing suitable for nuclear, chemical processing and other industrial applications using hot isostatic pressing (HIP) to achieve good bonding between layers.

BACKGROUND OF THE INVENTION

In the conventional process for fabricating seamless tubing with multi-layered metals, coextrusion is generally applied. The extrusion billet is assembled with multiple layers of metallic cylinders one inside the other concentrically. The annular opening at each end of the assembly is sealed by vacuum welding. The billet assembly is preheated to a proper temperature and extruded, forming a metallurgical bond between adjacent layers. The bondline defects are occasionally detected at the as-extruded stage or after the tube is further reduced. The main cause for this problem is due to insufficient time at temperature to effect bonding and diffusion across the bondline during extrusion.

In the conventional process for preparation of two-layered zirconium-zirconium alloy billet, the outer zirconium alloy and inner machined zirconium component are assembled after cleaning and pickling. The annular opening at both ends of the assembly is sealed under vacuum by electron beam welding. The billet assembly is preheated to a temperature range of 600 degrees C. to 750 degrees C. and extruded. The bond between two metallic layers is effected by the extrusion process. Because of the short duration of extrusion process, bondline defects may occur at points between these metallic layers. Products for nuclear applications often require stringent inspection, such as ultrasonic techniques, bondline defects as small as a few thousandths of an inch in dimension, may still be detected. The present invention provides a process to improve the bonding between metallic layers of the coextrusion. It also provides a method to heal the bondline defects for the tube already extruded or further reduced from the billets, particularly those which were not first treated by the HIP process.

It is, therefore, an objective of the present invention to reduce or eliminate the occurrence of bondline defects in concentric mating surface for tubing having multiple metallic layers.

It is a further objective of the present invention to promote maximum bond strength with diffusion across the interface between the inner and outer metallic layers.

It is still another object of this invention to provide a process which is capable of healing bondline defects in extruded tubes.

BRIEF SUMMARY OF THE INVENTION

The foregoing and further objects and advantages of the invention hereinafter described are achieved by relatively elevated temperature isostatic pressing of a multilayered metallic billet to promote diffusion across the interface to substantially reduce bondline defects between mating materials at their interface. The invention is particularly useful in the manufacture of billets made of two or more zirconium or zirconium alloy cylindrical layers which are to be further reduced to fuel cladding tubes for use in the nuclear industries which use requires stringent inspection for and avoidance of bondline defects.

The desirable results obtained by this invention are effected by exposing the billet assembly to hot isostatic pressing (HIP) for a short period of time, such as up to a few hours. The invention also contemplates using the HIP process to heal already-formed bondline defects in those tubes already extruded or further reduced from the billets.

DETAILED DESCRIPTION OF THE INVENTION

In the process of the present invention, the substantially defect-free bonding at the interface between concentric cylindrical tubes is achieved by hot isostatic pressing of the billet assembly at a relative low temperature with a high pressure, sufficient to cause bonding at the interface.

Figure 1:
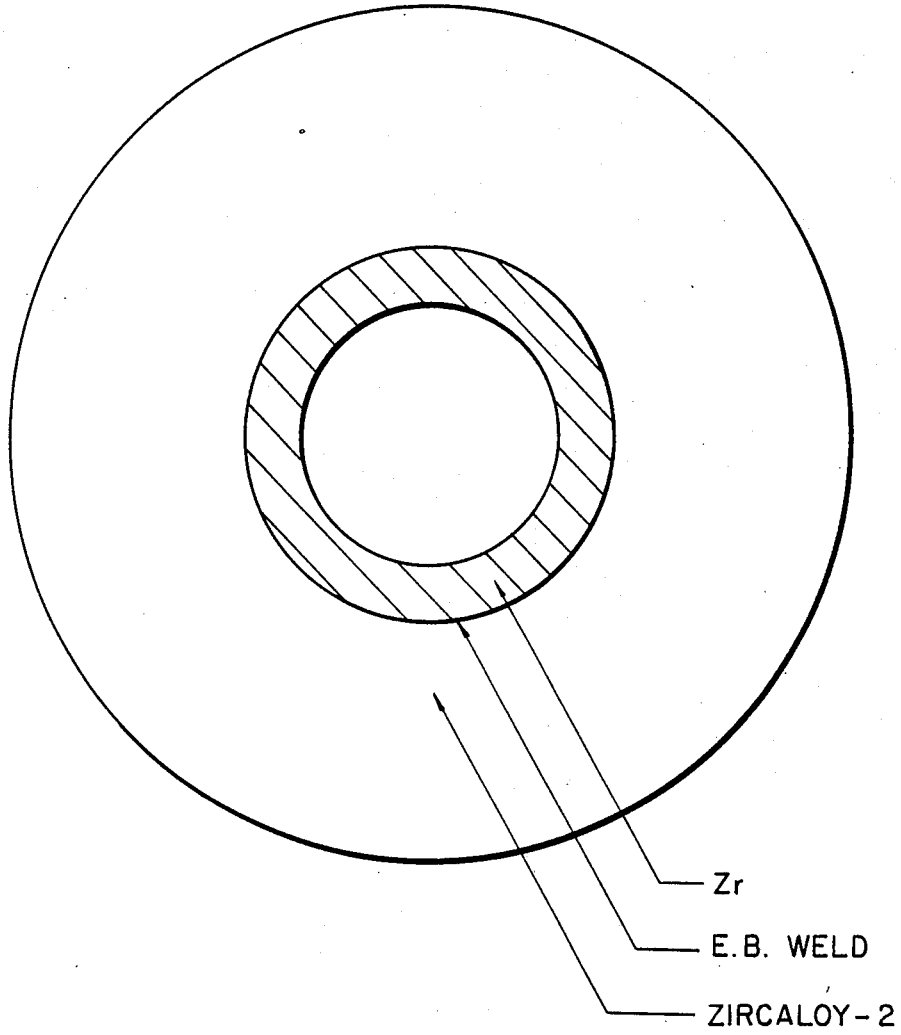
FIG. 1 is a cross-sectional view of an assembled two-layered metallic billet. The outer layer is Zircaloy-2 and the inside layer is zirconium.

For a billet of Zircaloy on the outside and zirconium on the inside, as shown in FIG. 1, both cylindrical parts are cleaned, assembled and vacuum welded. More specifically, before being assembled, the components of a coextrusion billet are cleaned and pickled to ensure that no detectable foreign materials are present between the metallic layers. The assembly is loaded into a chamber, and, after evacuation, the annular openings at both ends of the assembly are sealed with electron beam welding.

DESCRIPTION OF THE PREFERRED EMBODIMENTS

Once the coextrusion billet is assembled as above described, it is treated in an appropriate vessel for HIP. The temperature for the subsequent hot isostatic pressing ranges from about 450 degrees C to 800 degrees C and preferably 600 degrees C to about 750 degrees C, and the argon pressure ranges from 15,000 to 45,000 psi, as is generally commercially available in the industry. It will be understood that other inert gases can also be used effectively.

In another preferred embodiment, extruded tube material are treated with HIP in order to heal the bondline defects between the metallic layers of the zirconium and Zircaloy-2 which are known to exist.

Figure 3:
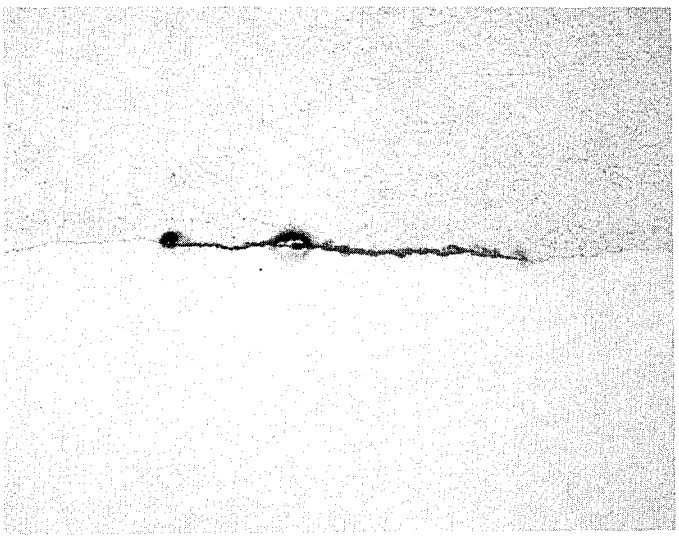
FIG. 3 is a photomicrograph of bondline defect between upper zirconium and lower Zircaloy-2 materials from a conventional extrusion at 180×.

When the billet is thus prepared, and extruded or further reduced into tubing, the bondline will be relatively free of defects. FIG. 3 shows a typical bondline defect obtained from the conventional practice of the prior art and is shown for comparison purposes with the product produced by the practice of the present invention.

The following examples will further clarify the process.

EXAMPLE 1

An assembled and welded billet of zirconium and Zircaloy-2 (Zr.1.5%Sn- 0.2%Fe- 0.1%Cr-0.05Ni) billet, 7.320" OD×2.1" ID×length (as shown in FIG. 1), was treated in a hot isostatic pressing vessel, under 15,000 psi argon pressure and at 615 degrees C. for 3 hours.

Figure 2:
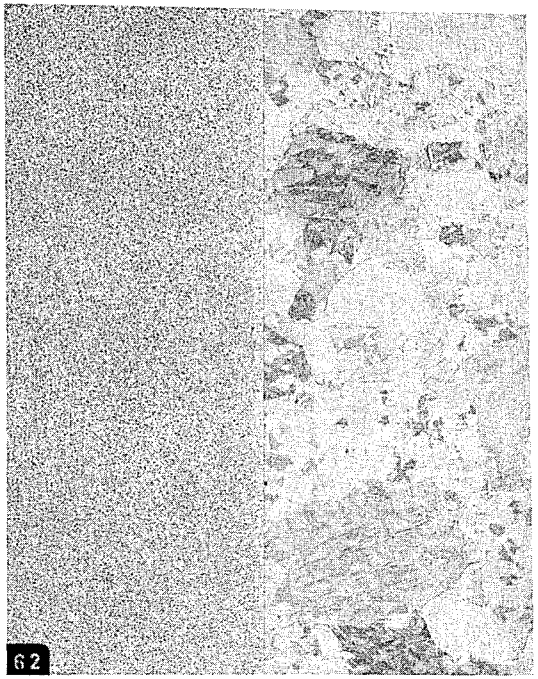
FIG. 2 is a photomicrograph of non-diffused bondline between upper Zircaloy-2 and lower zirconium layers of material prepared according to the present invention.

A sample was taken from the treated billet and prepared for microstructure examination. A good bond is formed between two metallic layers as shown in FIG. 2. This bond is so strong that applying a chisel along the bondline with force, failed to separate the metal layers.

EXAMPLE 2

Five coextrusions of zirconium and Zircaloy-2 obtained by the methods described in the prior art and not previously treated by HIP process at the billet stage, were examined for microstructure and all exhibited numerous bondline defects. These extruded tubes were then treated in an appropriate HIP vessel under an argon pressure of 15,000 p.s.i. at 615 degrees C. for about three hours. After this treatment, ultrasonic inspection was performed and the defects first observed were not now detected indicating they had been healed.

The present invention has been described in its preferred embodiment. It will be appreciated, however, that the advantages obtained can be achieved with a wide variety of material sizes utilizing the teachings contained herein. The invention described therefore is intended to be limited only by the scope of the appended claims in view of the pertinent prior art.

I claim:

1. In a process for making an extrusion billet comprising two or more concentric cylindrical layers of zirconium or zirconium alloys with hot isostatic pressing, the improvement which comprises:

further treating the billet by hot isostatic pressing under sufficient pressure and proper temperature to form a bond between the metallic layers characterized by improved bonding strength and reduced bondline defects.

2. Tubing produced from the billet process of claim 1 having improved metallurgical bond and substantially free from bondline defects.

3. A process of claim 1 in which said layers comprise at least one zirconium and at least one zirconium alloy.

4. A process of claim 1 for further treatment of extruded tubes.

5. A process of claim 1 wherein the pressure used in the further treatment ranges from 15,000 to 45,000 p.s.i. using argon as the medium.

6. A process of claim 1 wherein the temperature for the further treatment of the high pressure treatment is between 450 degrees C. and 800 degrees C.

* * * * *